United States Patent [19]

Adam

[11] 4,125,010

[45] Nov. 14, 1978

[54] HYDRAULIC PRESS

[75] Inventor: Klaus Adam, Waghäusel, Fed. Rep. of Germany

[73] Assignee: SMG-Süddeutsche Maschinenbau GmbH, Fed. Rep. of Germany

[21] Appl. No.: 772,765

[22] Filed: Feb. 28, 1977

[30] Foreign Application Priority Data

Feb. 26, 1976 [DE] Fed. Rep. of Germany ..... 2607762

[51] Int. Cl.[2] ..... B21J 9/12

[52] U.S. Cl. ..... 72/453.06; 72/453.08

[58] Field of Search ..... 72/453.06, 453.08, 441, 72/444, 443

[56] References Cited

U.S. PATENT DOCUMENTS

| | | | |
|---|---|---|---|
| 2,380,153 | 7/1945 | Davis | 72/453.08 |
| 2,594,204 | 4/1952 | Nowak | 72/453.06 |
| 3,158,046 | 11/1964 | Steinfort | 72/453.08 |
| 3,173,286 | 3/1965 | Dischler | 72/453.06 |
| 3,507,143 | 4/1970 | Georg | 72/453.08 |

*Primary Examiner*—C.W. Lanham
*Assistant Examiner*—Gene P. Crosby
*Attorney, Agent, or Firm*—Craig & Antonelli

[57] ABSTRACT

A hydraulic press which includes at least one cylinder piston unit for selectively displacing a punch. The cylinder piston unit includes at least one working chamber which communicates with a reversible continuously operating working pressure medium supplier having a variable output. At least one action stroke pressure unit is operatively connected to the punch and acts upon the same only during a segment of the motion of the punch in an action stroke direction. The action stroke pressure unit is temporarily connected to a pressure medium source having a higher pressure than the pressure produced by the pressure medium supplier.

12 Claims, 1 Drawing Figure

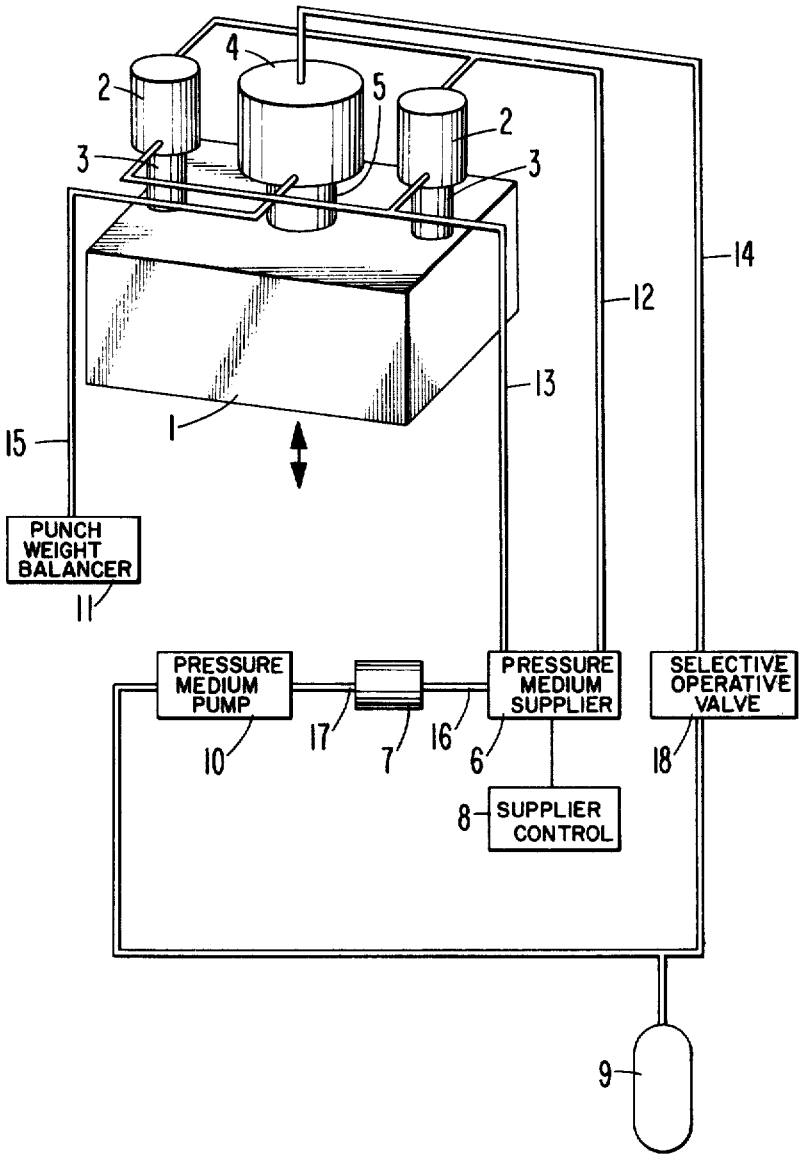
4
2
5
2
3
3
14
12
13
1
15
PUNCH WEIGHT BALANCER
11
PRESSURE MEDIUM PUMP
PRESSURE MEDIUM SUPPLIER
SELECTIVE OPERATIVE VALVE
10
17
7
16
6
18
8
SUPPLIER CONTROL
9

HYDRAULIC PRESS

The present invention relates to a press arrangement and, more particularly, to a hydraulic deep-drawing press arrangement having at least one cylindrical piston unit, arranged on a press frame, acting upon a punch with the cylinder piston unit including at least one working chamber communicating with a reversible constantly operating pressure medium supply means having a continuously variable output over a given period of time.

In one proposed hydraulic deep-drawing press disclosed, for example, in German Journal *Olhydraulik und Pneumatik* 13 (1969), No. 10 at page 476, a cylinder piston unit acts as the sole drive for the punch aside from the normal effects of gravity acting on the press punch. By virtue of such an arrangement, with a half-closed hydraulic circuit containing a pressure medium supplier and the cylinder piston unit, it is possible to effect movements of the punch in both an action stroke and a return stroke direction up to the beginning of a drawing operation, as well as a movement of the punch in an action stroke direction during a drawing operation.

One disadvantage of the hydraulic press arrangement disclosed in the afore mentioned publication resides in the fact that all of the elements in the hydraulic circuit, especially the pressure medium supplier and the cylinder piston unit, are designed so as to take into account the necessary work capability of the hydraulic press that is required during a drawing operation, although such work capability is not necessary during remaining portions of the motion of the punch. The aim underlying the present invention essentially resides in improving a hydraulic press arrangement of the afore mentioned type. For this purpose, a construction is provided whereby a greater work capability on the punch of the press is developed during a portion or segment of the motion of the punch in an action stroke direction during the execution of a working step such as, for example, deep drawing.

By virtue of the construction of the present invention, the advantage of a hydraulic circuit such as described in the above-noted publication is maintained and, additionally, it is possible to control movements of the punch so that the punch will be either free of shock or the shock will be kept to a minimum amount. Thus, according to the present invention, a sinusoidal variation of speed during a movement of the punch is obtainable without providing an oversized or considerably large hydraulic circuit.

According to one feature of the present invention, at least one supplementary action stroke pressure unit working in the action stroke direction is arranged on the press frame and acts upon the punch with the action stroke pressure unit, during at least a portion of the motion of the punch in the action stroke direction, being temporarily connected to a source of pressure medium having a higher pressure than a pressure created by the pressure medium supplier.

One advantage of the above-noted feature of the present invention resides in the fact that, during an execution of a work step, for example, deep drawing, the work capability of the cylinder piston unit acted upon by the pressure medium supplier or the effect of gravity on the punch of the press is amplified or reinforced by the work capability of the action stroke pressure unit acted upon by the pressure medium source.

In accordance with a further advantageous feature of the present invention, the pressure medium source acting upon the action stroke pressure unit is constructed as a pressure medium reservoir which is charged or filled by a constant delivery pressure medium pump with the energy of the pressure medium reservoir and the pump being brought to bear upon the action stroke pressure unit during an execution of the working step of the hydraulic press.

According to the present invention, the hydraulic pressure medium supplier and cylinder piston unit may be designed or arranged in an open circuit or in a half-closed circuit, whereby with a reduction of the motion of the punch during an execution of a working step, as opposed to a speed determination by an output control, part of the output from the pressure medium supplier may be carried off.

Additionally, in accordance with the present invention, the cylinder piston unit may be constructed so as to function as either a single-acting or double-acting cylinder piston unit, whereby in the former case, the motion in one direction is caused by the effects of gravity upon the punch during a portion of the punch motion with the execution of the work step being effected by the supplemental action of the action stroke pressure unit.

According to yet another feature of the present invention, the action stroke pressure unit is arranged in an open circuit together with the pressure medium source constructed as a pressure medium reservoir and a pressure medium pump.

To supplement the piston surfaces that are acted upon by the respective circuits of the pressure medium supplier, cylinder piston unit, action stroke pressure unit and pressure medium reservoir, according to the present invention, a punch weight balancing device may be provided at the cylinder piston unit and/or at the action stroke pressure unit, which balancing device communicates with working chambers of the piston unit and/or the action stroke pressure unit, whereby a pressure medium acts on the respective piston surfaces.

Accordingly, it is an object of the present invention to provide a hydraulic press arrangement which avoids by simple means the drawbacks and shortcomings encountered in the prior art.

A further object of the present invention resides in providing a hydraulic press arrangement in which a supplemental force is effective upon a punch of the press only during a predetermined portion or segment of the motion of the punch in an action or working stroke.

Yet another object of the present invention resides in providing a hydraulic press arrangement in which the movements of the punch are controlled so as to minimize, if not avoid, any adverse shock effects on the punch.

A still futher object of the present invention resides in providing a hydraulic press arrangement which utilizes a relatively simple hydraulic control circuit to control the movement of the pump under all operating conditions.

These and other objects, features and advantages of the present invention will become more apparent from the following description when taken in connection with the accompanying drawing which shows, for the purposes of illustration only, one embodiment in accordance with the present invention, and wherein:

The single FIGURE is a partial perspective schematic view of a hydraulic press arrangement in accordance with the present invention.

Referring now to the single FIGURE, a punch 1 is vertically displaceably guided on a frame (not shown) in a conventional manner with cylinders of a pair of cylinder piston units 2 being fixedly mounted at the frame. Each cylinder piston unit 2 includes a piston arranged in a cylinder and a piston rod 3 connected to the punch 1.

An action stroke pressure unit 4 is provided and includes a cylinder mounted at the frame and a piston accommodated in the cylinder having a piston rod 5 connected to the punch 1. In the illustrated embodiment, the action stroke of the punch 1 is directed vertically downward.

Each cylinder piston unit 2 is of a double-acting type and includes an upper and lower working chamber with the respective chambers being connected to a conventional pressure medium supplier 6, for example, a pivotable or swingable axial piston pump, by way of hydraulic lines 12, 13. A suitable drive motor 7 drives the pressure medium supplier 6 by way of a drive shaft 16. A conventional pressure medium supplier control means 8 is connected to the pressure medium supplier so as to control the quantity and direction of the output of the pressure medium supplier 6.

During an action stroke of the punch 1, the supplier control 8 acts upon the pressure medium supplier 6 so that, for example, the output from the supplier 6 is fed by way of the hydraulic line 12 to the upper working chambers of each of the cylinder piston units 2 to displace the punch 1 downwardly or in an action stroke direction. To raise the punch 1, the supplier control 8 acts upon the pressure medium supplier 6 so as to feed a pressure medium to the lower working chambers of each of the cylinder piston units 2 by way of a hydraulic line 13, whereby the punch 1 is raised or executes a return stroke in an upward direction. As is readily apparent the supplier control 8 may act upon the pressure medium supplier 6 so as to proportion the output to the upper and lower working chambers of the cylinder piston units 2 so that a controlled motion of the punch 1 in either an action or return stroke direction is obtained.

The action stroke pressure unit 4 includes at least one working chamber arranged above the piston of the unit 4 which selectively communieates through a selective operation valve 18 with a pressure medium source by way of a hydraulic line 14. The pressure medium source includes a pressure medium reservoir 9 and a pressure medium pump 10 driven by the drive motor 7.

To provide for a balancing of the weight of the punch 1, a balancing device 11, of conventional construction, for example, a slide valve or the like, is connected with a lower working chamber of the action stroke pressure unit 4 disposed below a lower piston surface of the unit 4. By virtue of the provision of the balancing device 11, a pressure medium may be selectively communicated, by way of a hydraulic line 14, to the lower working chamber of the action stroke pressure unit 4 so as to maintain, under all operating conditions, a balanced or even displacement of the punch 1 in the action stroke direction.

As is readily apparent, additional control elements and valves (not shown) are provided to ensure the normal operation of the hydraulic press; however, such control elements and valves are of a conventional construction and form no part of the present invention. By virtue of the driving of both the pressure medium supplier 6 and the pressure medium pump 10 by a single drive motor 7 through drive shafts 16 and 17, respectively, the hydraulic press not only allows for a maximum utilization of the power of the drive motor, but also a substantial reduction in the energy requirements of the hydraulic press.

In operation, the whole output of the pressure medium supplier 6 is only needed during segments of the motion of the punch 1, during which segments the pump is either accelerated or retarded against the effects of gravity. During the other segments of the movement of the punch, which would include a segment associated with the execution of a working step, the output of the drive motor 7, for the most part, is available for driving the pressure medium pump 10 because of the low energy requirements of the pressure medium supplier 6 during such other segments of motion.

By virtue of the construction of the pressure medium supplier 6 as, for example, a pivotable or swingable axial piston pump, it is possible to realize a partial recovery of the kinetic energy released during a slowing of the movement of the punch 1 prior to a dead center position because the axial piston pump acts as a hydraulic motor during this segment of motion of the punch 1 and serves to drive the pressure medium pump 10 in common with the drive motor 7. Thus, an increase of power of the hydraulic press results based on the installed power of the drive motor 7.

While I have shown and described only one embodiment in accordance with the present invention, it is understood that the same is not limited thereto, but is susceptible of numerous changes and modifications as known to a person skilled in the art, and I therefor do not wish to be limited to the details shown and described herein, but intend to cover all such changes and modifications as are encompassed by the scope of the appended claims.

I claim:

1. A hydraulic press which includes a punch, and at least one cylinder piston unit means for selectively displacing the punch, characterized in that at least one action stroke pressure means is operatively connected to the punch for acting upon the punch in an action stroke direction, and means are provided for controlling the operation of said action stroke pressure means so as to render said action stroke pressure means effective only during a predetermined portion of the displacement of the punch in the action stroke direction, characterized in that a pressure medium supplier means is operatively connected with said at least one cylinder piston unit means for causing a selective displacement of the punch, and in that said controlling means includes a pressure medium source connected by way of a selective operation valve means with said action stroke pressure means only during the predetermined portion of the displacement of the punch, characterized in that the pressure medium source includes a pressure medium reservoir and a pressure medium pump means, said pressure medium reservoir and said pressure medium pump means providing a pressure having a value greater than a pressure of the pressure medium supplier means, and in that means are provided for driving said pressure medium pump means, characterized in that said driving means includes a drive motor, said drive motor is operatively connected with both said pressure medium pump means and said pressure medium supplier means for effecting a common driving thereof.

2. A press according to claim 1, characterized in that said pressure medium supplier means is a reversible axial pump means having a continuously variable output quantity over a given length of time.

3. A press according to claim 2, characterized in that the at least one cylinder piston unit means includes at least one working chamber, and in that hydraulic line means are provided for communicating said at least one working chamber with said reversible axial pump means.

4. A press according to claim 3, characterized in that a punch weight balancing means is operatively connected with said action stroke piston pressure means for providing a balanced displacement of the punch in an action stroke direction.

5. A press according to claim 4, characterized in that the at least one cylinder piston unit means includes an upper working chamber and a lower working chamber selectively communicating with said pressure medium supplier means so as to permit control of the punch in an action stroke direction and in a return stroke direction.

6. A hydraulic press which includes a punch, and at least one cylinder piston unit means for selectively displacing the punch, characterized in that at least one action stroke pressure means is operatively connected to the punch for acting upon the punch in an action stroke direction, and means are provided for controlling the operation of said action stroke pressure means so as to render said action stroke pressure means effective only during a predetermined portion of the displacement of the punch in the action stroke direction, characterized in that two cylinder piston unit means are provided for selectively displacing the punch, characterized in that a pressure medium supplier means is operatively connected with the two cylinder piston unit means for causing selective displacement of the punch, and in that said controlling means includes a pressure medium source connected by way of a selective operation valve means with said action stroke pressure means only during the predetermined portion of the displacement of the punch, characterized in that the pressure medium source includes a pressure medium reservoir and a pressure medium pump means, said pressure medium reservoir and said pressure medium pump means providing a pressure having a value greater than a pressure of the pressure medium supplier means, and in that means are provided for driving said pressure medium pump means, characterized in that said driving means includes a drive motor, said drive motor is operatively connected with both said pressure pump means and said pressure medium supplier means for effecting a common driving thereof.

7. A press according to claim 6, characterized in that said pressure medium supplier means is a reversible axial pump means having a continuously variable output quantity over a given length of time.

8. A hydraulic press which includes a punch, and at least one cylinder piston unit means for selectively displacing the punch, characterized in that at least one action stroke pressure means is operatively connected to the punch for acting upon the punch in an action stroke direction, and means are provided for controlling the operation of said action stroke pressure means so as to render said action stroke pressure means effective only during a predetermined portion of the displacement of the punch in the action stroke direction, characterized in that a pressure medium supplier means is operatively connected with said at least one cylinder piston unit means for causing a selective displacement of the punch, and in that said controlling means includes a pressure medium source connected by way of a selective operation valve means with said action stroke pressure means only during the predetermined portion of the displacement of the punch, characterized in that the pressure medium source includes a pressure medium reservoir and a pressure medium pump means, said pressure medium reservoir and said pressure medium pump means providing a pressure having a value greater than a pressure of the pressure medium supplier means, and in that means are provided for driving said pressure medium pump means, and characterized in that said pressure medium supplier means is a reversible axial pump means having a continuously variable output quantity over a given length of time.

9. A press according to claim 8, characterized in that the at least one cylinder piston means includes at least one working chamber, and in that hydraulic line means are provided for communicating said at least one working chamber with said reversible axial pump means.

10. A press according to claim 9, characterized in that a punch weight balancing means is operatively connected with said action stroke piston pressure means for providing a balanced displacement of the punch in an action stroke direction.

11. A hydraulic press which includes a punch, and at least one cylinder piston unit means for selectively displacing the punch, characterized in that at least one action stroke pressure means is operatively connected to the punch for acting upon the punch in an action stroke direction, and means are provided for controlling the operation of said action stroke pressure means so as to render said action stroke pressure means effective only during a predetermined portion of the displacement of the punch in the action stroke direction, characterized in that a pressure medium supplier means is operatively connected with said at least one cylinder piston unit means for causing a selective displacement of the punch, and in that said controlling means includes a pressure medium source connected by way of a selective operation valve means with said action stroke pressure means only during the predetermined portion of the displacement of the punch, characterized in that the pressure medium source includes a pressure medium reservoir and a pressure medium pump means, said pressure medium pump means providing a pressure having a value greater than a pressure of the pressure medium supplier means, and in that means are provided for driving said pressure medium pump means, and characterized in that the at least one cylinder piston unit means includes an upper working chamber and a lower working chamber selectively communicating with said pressure medium supplier means so as to permit control of the punch in an action stroke direction and in a return stroke direction.

12. A hydraulic press which includes a punch, and at least one cylinder piston unit means for selectively displacing the punch, characterized in that at least one action stroke pressure means is operatively connected to the punch for acting upon the punch in an action stroke direction, and means are provided for controlling the operation of said action stroke pressure means so as to render said action stroke pressure means effective only during a predetermined portion of the displacement of the punch in the action stroke direction, characterized in that two cylinder piston unit means are provided for selectively displacing the punch, characterized in that a pressure medium supplier means is operatively connected with the two cylinder piston unit means for causing selective displacement of the punch, and in that said controlling means includes a pressure medium source connected by way of a selective operation valve means with said action stroke pressure means only during the predetermined portion of the displacement of the punch, characterized in that the pressure medium source includes a pressure medium reservoir and a pressure medium pump means, said pressure medium reservoir and said pressure medium pump means providing a pressure having a value greater than a pressure of the pressure medium supplier means, and in that means are provided for driving said pressure medium pump means, and characterized in that said pressure medium supplier means is a reversible axial pump means having a continuously variable output quantity over a given length of time.

* * * * *